US005887808A

United States Patent [19]

Lucas

[11] Patent Number: 5,887,808

[45] Date of Patent: Mar. 30, 1999

[54] HIGH EFFICIENCY GRINDING APPARATUS

[75] Inventor: Richard V. Lucas, Jordan, Minn.

[73] Assignee: Scott Equipment Company, New Prague, Minn.

[21] Appl. No.: 3,211

[22] Filed: Jan. 6, 1998

[51] Int. Cl.[6] ..... B02C 13/284

[52] U.S. Cl. ..... 241/82; 241/88.4; 241/188.1; 241/192; 241/195

[58] Field of Search ..... 241/188.1, 73, 241/88.4, 81, 82, 189.1, 192, 195

[56] References Cited

U.S. PATENT DOCUMENTS

| | | | |
|---|---|---|---|
| 1,625,554 | 4/1927 | Liggett | 241/88.4 |
| 1,751,009 | 3/1930 | Liggett | 241/88.4 |
| 3,677,478 | 7/1972 | Schutte . | |
| 3,973,735 | 8/1976 | Ito et al. . | |
| 4,076,177 | 2/1978 | Hirayama et al. . | |
| 4,129,260 | 12/1978 | Baker . | |
| 4,131,247 | 12/1978 | Danberg . | |
| 4,226,375 | 10/1980 | Cameron | 241/89.3 |
| 4,325,516 | 4/1982 | Ismar | 241/188.1 |
| 4,767,066 | 8/1988 | Williams . | |
| 4,830,291 | 5/1989 | Williams . | |
| 5,062,575 | 11/1991 | Barnabie et al. . | |
| 5,199,653 | 4/1993 | Durrant et al. . | |
| 5,526,988 | 6/1996 | Rine . | |
| 5,570,517 | 11/1996 | Luker . | |

OTHER PUBLICATIONS

Scott Equipment's marketing brochure entitled "Continuous Process Equipment".

Scott Equipment's marketing brochure entitled "Scott's New Cooler System".

Scott Equipment's marketing brochure entitled "Scott A.S.T. Dryer".

Scott Equipment's marketing brochure entitled "Scott's New Turbo Dominator".

*Primary Examiner*—Mark Rosenbaum

*Attorney, Agent, or Firm*—Dwight N. Holmbo

[57] ABSTRACT

A grinding apparatus optimizes grinding efficiency within the grinding chamber by providing grinding action over a 360° range encompassed by a set of breaker bars and one or more arcuate screening elements. Arcuate screening elements have an inside radius that identically matches the inside radius of the breaker bars. The screening elements act as grinding mechanisms as well as more conventional filtering mechanisms due to increased grinding capacity when the inside radial surface of the screening elements and the inside radial surface defined by the breaker bars are equidistant from the axis of a rotational shaft that supports a plurality of circumferentially spaced hammers.

33 Claims, 5 Drawing Sheets

HIGH EFFICIENCY GRINDING APPARATUS

BACKGROUND OF THE INVENTION

1. Field of the Invention

This invention relates to grinding apparatus. More particularly, this invention relates to a grinding apparatus that facilitates highly efficient grinding of granular and large particle products as well as tough fiber dry grain products such as barely and waste gypsum.

2. Description of the Prior Art

Present product grinding and comminuting apparatus are known in the art for reducing the size of materials such as food products, chemicals, rubbers, resins, garbage (food waste), waste-paper, wood chips, waste fiber (cloth, gypsum), plastics, glass, metal chips or the like. Conventional grinding/comminuting apparatus such as that disclosed in U.S. Pat. No. 4,129,260, issued Dec. 12, 1978 to Baker, entitled *Garbage Disposal*, and U.S. Pat. No. 3,973,735, issued Aug. 10, 1976 to Ito et al., entitled *Apparatus For Pulverizing And Sorting Municipal Waste*, typically include a grinding chamber with high speed rotating beaters/hammers that tear, shred, slash, cut and grind one or more desired products to a desired particle size as the desired product(s) are forced between the rotating beaters/hammers and a set of breaker bars and to a very limited extent, also between the rotating beaters/hammers and one or more screening elements. Conventional screening elements for grinding and comminuting apparatus such as disclosed in U.S. Pat. No. 5,526,988, issued Jun. 18, 1996 to Rine, entitled *Comminuting Apparatus With Tangentially Directed Discharge*, are generally well known items and are currently in wide-spread use. These screening elements may include herringbone slots, round perforations, cross slot perforation screens, and jump gap screens in combination with a drum-type structure such as disclosed in U.S. Pat. No. 4,076,177, issued Feb. 28, 1978 to Hirayama et al., entitled *Pulverizing Method And Apparatus*, to form a grinding/comminuting apparatus for feeding the constituents axially there through so that the resulting pulverized constituents can be discharged at different axial positions depending upon the progress of pulverization and the selected screening elements. A significant disadvantage accompanying conventional grinding/comminuting apparatus known and used in the art is reduced grinding/comminuting efficiency due to the different radial distance between the axial centerline of the rotating shaft used to rotate the beaters/hammers and the working surfaces of the screening elements as compared with the working surfaces of the beaters/hammers. For example, known grinding/comminuting apparatus of the type using breaker bars and screening elements use the breaker bars to accomplish nearly all grinding/comminuting action of constituents that ultimately pass through the aforesaid screening elements. Constituents that do not immediately pass through the screening elements continue to be pulverized between the beaters/hammers and the breaker bars until sufficiently reduced to a size that is sufficiently small to allow the filtering process to continue to completion. It is readily apparent from the above, that the grinding/comminuting action that occurs in a drum type apparatus is one of the important factors in providing a highly efficient pulverizing process.

SUMMARY OF THE INVENTION

Accordingly, the present inventive grinding apparatus provides a structure and method intended to overcome many of the shortcomings and attendant disadvantages of known pulverizing, grinding and comminuting apparatus that share problems considered unavoidable within the industry, some of which have been discussed herein above. The present invention, however, surmounts many of these problems with a radical new structure that accommodates novel placement of selected screening elements to enhance and optimize pulverizing, grinding and comminuting efficiency. The apparatus constructed according to the present invention comprises at least one product inlet (feeder) section, one or more grinding/pulverizing chambers (sections) and one or more product discharge sections (ports) to accommodate collection of the comminuted product(s). A rotating shaft having a plurality of beaters/hammers coupled radially and circumferentially spaced thereto extends axially through the product grinding chamber(s) such that the rotating shaft and the grinding chamber(s) share a common central axis. The one or more grinding/pulverizing sections include one or more arcuate screening elements coupled to the inner surface of a cylindrical housing such that the radial distance between the axis of the rotating shaft and the inner surface of the arcuate screening elements is identical with the radial distance between the axis of the rotating shaft and the grinding/comminuting end surfaces of the beaters/hammers. The unique structural placement of the screening elements provides additional grinding action as the beaters/hammers rotate past the screening elements such that the aforesaid screening elements participate in the comminuting process rather than being limited substantially to filtering of particular constituent particle sizes. A series of precisely sized ribs (back bars) is optionally attached to the selected portions of the inner surface of the pulverizing section(s) cylinder housing to act as a mounting structure for the selected screening element(s). A series of arcuate or substantially straight back bars can also be coupled to the arcuate screening element(s) to form a portion of the grinding chamber cylinder housing such that the portion of the grinding chamber cylinder housing the arcuate screening element(s) will be perforated. The size of the back bars is dependent upon the thickness of the selected screening element(s), which to a certain extent, is dependent upon the choice of material utilized to construct the aforesaid screening element (s). Because the working surfaces defined by the inner radius of the screening element(s) and the breaker bars are equidistant from the central axis of the rotating shaft, the desired grinding/comminuting action occurs whenever the beaters/hammers are moving past a screening element or a breaker bar. This action contrasts sharply with known grinding, pulverizing, comminuting apparatus where little or no grinding/comminuting action occurs as the beaters/hammers move past a screening element where the working surface(s) of the associated screening element(s) are displaced a greater distance from the beaters/hammers than are the working surface(s) of the associated breaker bars.

Another feature of the present invention is the provision of a grinding apparatus having multiple screens thereby allowing filtering and separation of constituents having a plurality of desired particle sizes, e.g. mesh.

Yet another feature of the present invention is the provision of a grinding apparatus having multiple separators thereby allowing collection of constituents having a plurality of desired particle sizes, e.g. mesh.

Still another feature of the present invention is the provision of a grinding apparatus having an overflow separator thereby allowing collection of constituents having a desired particle size such that operating efficiency of the grinding apparatus will not be impaired due to clogging action.

Another feature of the present invention is the provision of a grinding apparatus having hammers/beater blades with adjustable pitch such that flow rate of product through the grinding apparatus can be controlled via a desired selectable slashing angle/cutting action.

Yet another feature of the present invention is the provision of a grinding apparatus having a centrifugal trap to capture foreign debris, e.g. metal and/or stones.

Still another feature of the present invention is the provision of a grinding apparatus having adjustable length beaters/hammers thereby allowing close tolerances to be maintained between beaters/hammers and the screen element(s) as well as between beaters/hammers and the breaker bars.

Another feature of the present invention is the provision of a grinding apparatus having a long cylindrical housing adapted to support efficient grinding of tough fiber products, e.g. barley and/or waste gypsum, such that fiber build-up on any screen element is eliminated to allow more efficient screening of the low fiber portion of the products.

Yet another feature of the present invention is the provision of a grinding apparatus having an escape element allowing for easy removal of unwanted foreign material entering the grinding apparatus such that severe damage to screening elements is effectively eliminated.

Still another feature of the present invention is the provision of a grinding apparatus including beaters/hammers having widths adapted to cover the entire area encompassed by the screen elements such that operating efficiency is optimized.

Another feature of the present invention is the provision of a grinding apparatus including beaters/hammers having selectively interchangeable configurations and further, having sides constructed of selectively interchangeable materials.

Yet another feature of the present invention is the provision of a grinding apparatus having a variable speed drive mechanism allowing for optimized grinding efficiency for a plurality of different products.

Still another feature of the present invention is the provision of a grinding apparatus having adjustable pitch beater (s)/hammer(s) paddles to produce a fan action toward the discharge end of the grinding apparatus such that dust removal can be accomplished without necessitating negative air flow.

Another feature of the present invention is the provision of a grinding apparatus having individually adjustable and individually replaceable beaters/hammers.

Yet another feature of the present invention is the provision of a grinding apparatus adapted to provide access to the beaters/hammers without disconnecting product inlet or discharge portions of the grinding apparatus.

From the foregoing, it is clear that the present inventive grinding apparatus performance is greatly enhanced over existing systems. Other features of the present inventive apparatus include ease of use, manufacture, enhanced serviceability, maintainability, upgradability, and enhanced expansion and diagnostics capability.

BRIEF DESCRIPTION OF THE DRAWINGS

Other objects and features of the present invention and many of the attendant advantages of the present invention will be readily appreciated as the same becomes better understood by reference to the detailed description when considered in connection with the accompanying drawings in which like reference numerals designate like parts throughout the figures thereof and wherein.

While the above-identified drawing figures set forth alternative embodiments, other embodiments of the present invention are also contemplated, as noted in the discussion. In all cases, this disclosure presents illustrated embodiments of the present invention by way or representation and not limitation. Numerous other modifications and embodiments can be devised by those skilled in the art which fall within the scope and spirit of the principles of this invention.

DETAILED DESCRIPTION OF THE PREFERRED EMBODIMENT(S)

The preferred embodiments described as follows address the long felt need by those in the waste disposal and recycling industries to provide a highly efficient comminuting apparatus capable of handling a wide variety of applications, wet or dry, even where purity standards must be maintained. In accordance with the present invention, the preferred embodiments described herein can readily separate snack foods, dry and wet soup mixes, bakery goods, gelatins, cereals, soft drinks, juices, milk, dry drink mixes and additional products such as detergents and canned and frozen vegetables. The preferred embodiments described herein can also be used to handle products such as, but not limited to, grains such as oats, corn mils, barley, and the like as well as large particle products like gypsum board, plaster, glass, etc.

Figure 1:
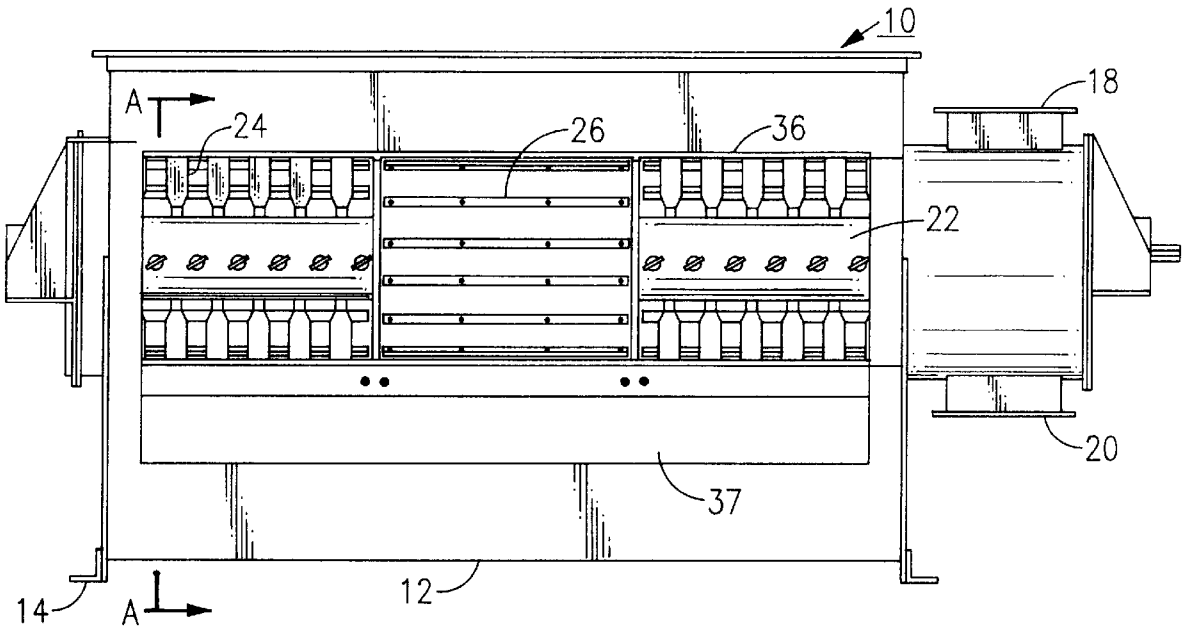
FIG. 1 illustrates a side cutaway view of a grinding apparatus in conformance with one embodiment of the present invention.

Looking now at FIG. 1, a side cutaway view of a grinding apparatus 10 is illustrated in conformance with one preferred embodiment of the present invention. Apparatus 10 includes a support structure 12 having mounting flanges 14 to position and support a cylindrical grinding chamber housing 36 coupled to a product collection chamber 37. A product inlet port 18 is used to introduce one or more desired products into the cylindrical grinding chamber housing 36 where the desired product(s) is comminuted to a desired particle size.

The aforesaid comminuting process is achieved via a set of beaters/hammers 24 attached to a high speed rotating solid shaft 22 in a manner familiar to those skilled in the grinding/pulverizing art, e.g. hammer mills. A set of hardened metal breaker bars 26 is selectively attached to a portion of the inner surface of the cylindrical grinding chamber housing 36, also well known to those skilled in the art. As the shaft 22 rotates, product entering the cylindrical grinding chamber housing 36 is forced past the breaker bars 26 via the rotational movement of the beaters/hammers 24, thereby comminuting the product. It can readily be appreciated that the rotation speed of the beaters/hammers 24 as well as the shape and pitch of the beaters/hammers 24 will determine the amount of time a particular product is being comminuted within the grinding chamber housing 36. Preferably, grinding apparatus 10 includes a product escape port 20 that can be utilized to remove any piece of foreign material that may inadvertently enter the comminuting chamber cylinder housing 36 before severe damage is caused to internal components of the grinding apparatus 10. The foreign material will be forced into the product escape port 20 via the fan action of the beaters/hammers 24. This feature provides an enhanced level of operating safety and reliability hereto before unknown in the waste disposal, product recycling and product blending industries. Another discharge (see 204 in FIG. 10) at the opposite end is used to discharge the container into a separate package.

Figure 2:
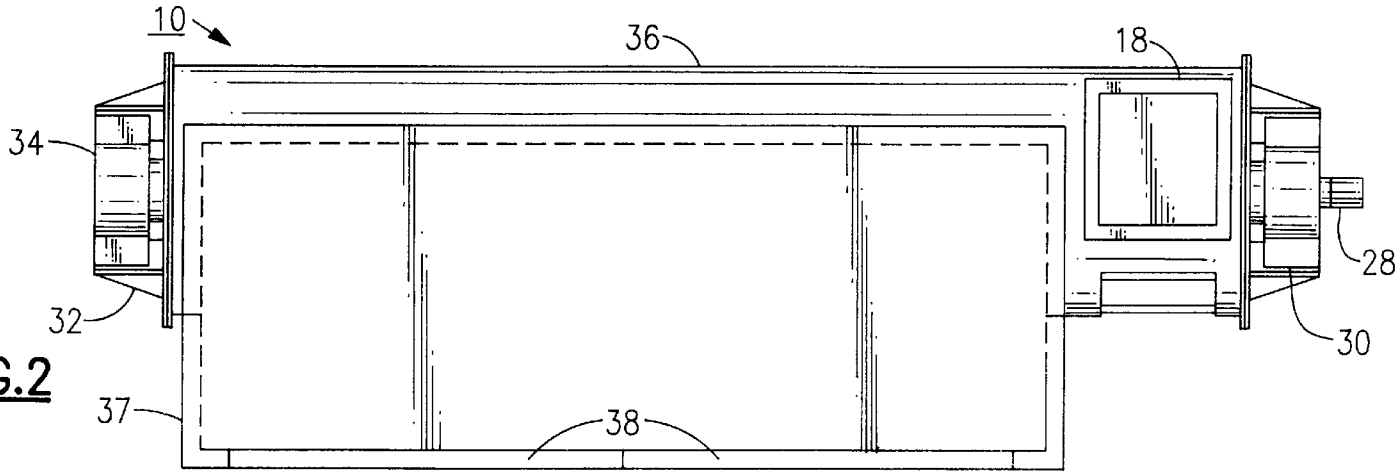
FIG. 2 illustrates a top view of the grinding apparatus shown in FIG. 1.

FIG. 2 illustrates a top view of the grinding apparatus 10 shown in FIG. 1. The aforesaid rotational shaft 22 is supported at one end via a pillow block bearing 32 having an opening 34 sized to accept one end of the rotational shaft 22. The rotational shaft 22 is supported at its opposite end via a second pillow block bearing 30. A portion of the rotational shaft 22 is reduced to form a drive shaft 28 suitable for use with a totally enclosed, fan cooled (TEFC), variable speed drive motor (enumerated as 206 in FIG. 10). It will readily be appreciated by those skilled in the motor art however, that the present invention is not so limited and that many other types of drive motors can just as well be used to rotate the drive shaft 28, so long as the selected drive motor is capable of rotating the drive shaft 28 at the desired speed(s). One or more pulley assemblies (enumerated as 208 in FIG. 10) is preferably coupled to the drive shaft 28 such that a desired number of v-belts (enumerated as 207 in FIG. 10) can be used to coupled the variable speed motor 206 to the rotatable drive shaft 28. The present invention is not so limited however, and it shall be understood that the present invention can also function with or without a variable speed drive or without need of a v-belt. For example, the drive motor can just as well be coupled directly to the grinder drive shaft 28 in a manner familiar to those skilled in the art. With continued reference to FIG. 2, the product collection chamber 37 preferably has one or more access doors 38 to allow access to the beaters/hammers 24, breaker bars 26, or any other internal components without requiring removal of any spouting attached to the grinding apparatus 10, thereby reducing undesirable down time during normal maintenance of the grinding apparatus 10.

Figure 3:
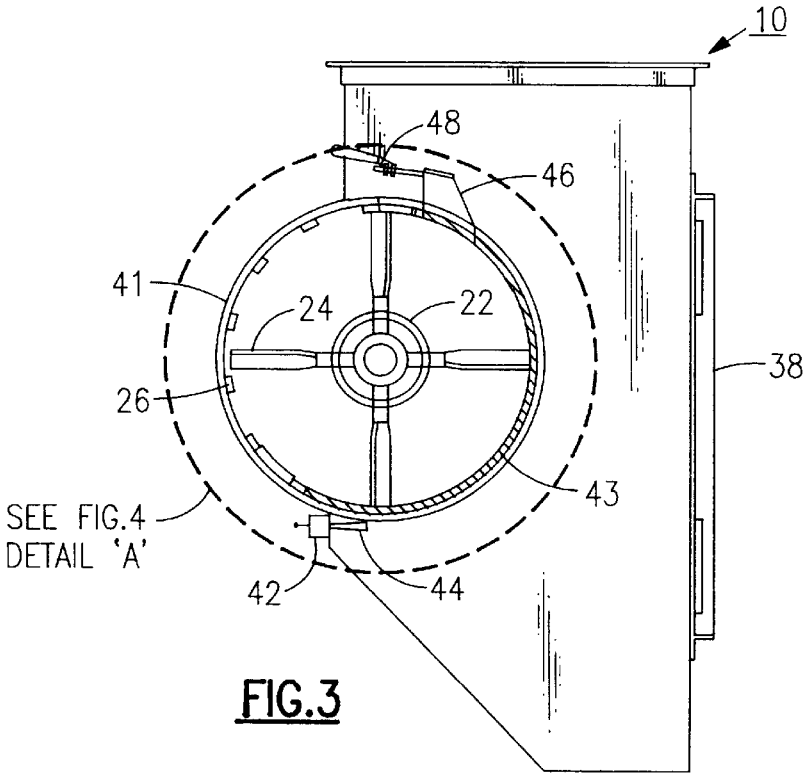
FIG. 3 illustrates a front end view of the grinding apparatus shown in FIG. 1.

FIG. 3 illustrates a partial front end view of the grinding apparatus 10 depicted in FIG. 1. It can be seen that opening the chamber access door(s) 38 allows easy access to any of the internal components, e.g. beaters 24, breaker bars 26, rotating shaft 22, eye bolt 44, latches 48, and the like that may require periodic maintenance. The access door(s) 38 also allows internal access to the product collection chamber structure 37 itself such that comminuted product can be examined or removed if so desired. Those skilled in the art will readily appreciate that the present invention is not limited to the particular structure depicted in FIG. 3 and that many other chamber structures 37 and support structures 12 may just as well be utilized so long as the grinding chamber housing 36 can be supported to accomplish the desired comminuting process.

Figure 4:
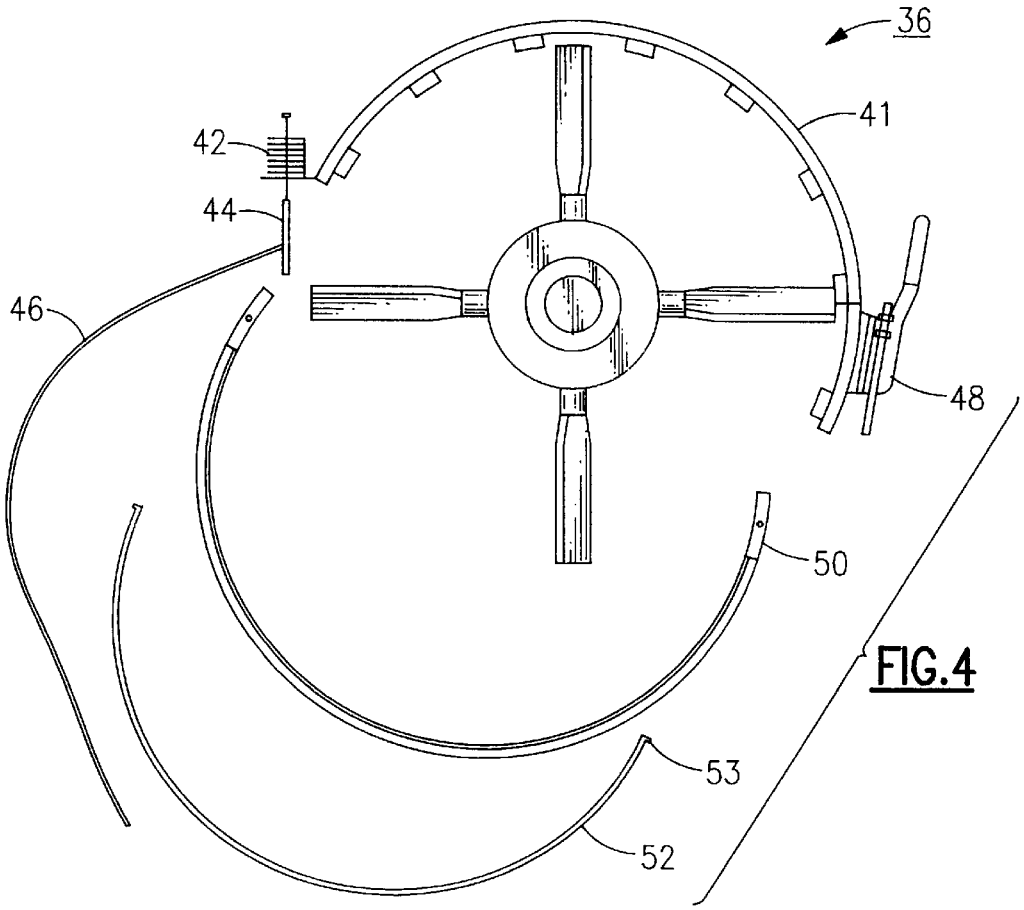
FIG. 4 illustrates a detailed view of a portion of the grinding apparatus shown in FIG. 1, depicting attachment of a screening element in conformance with one preferred embodiment of the present invention.

FIG. 4 illustrates a portion of the grinding chamber cylinder housing 36 depicted as DETAIL 'A' in FIG. 3. It can be seen that the cylindrical grinding chamber housing 36 is formed partially by a solid arcuate element (wall portion) 41 while the remainder of the cylindrical grinding chamber housing 36 is completed via a set of arcuate back bars 50 having keyways (enumerated as 57 in FIG. 11) and one or more arcuate screening elements 52 having keys 53 for mating securely to the back bars 50 to form a perforated arcuate element (wall portion) 43. It will be appreciated that the aforesaid perforated arcuate element 43 of the cylindrical grinding chamber housing 36 can just as well be formed by attaching one or more substantially straight back bars 50 to the arcuate screening element(s) 52 simply by placing the aforesaid substantially straight back bars 50 in a direction substantially perpendicular to the rotational path of the hammers 24. A plurality of chain elements 46 are coupled to one end of the arcuate element 41 via a set of compression springs 42 and eye bolts 44. The present invention is not so limited however, and it shall be understood that any number of well known coupling mechanisms can just as well be used to mate the solid arcuate wall element 41 and the perforated arcuate wall element 43 to form the illustrated cylindrical grinding chamber housing 36. The cylindrical grinding chamber housing 36 is constructed by attaching the aforesaid set of back bars 50 and arcuate screening element(s) 52 to the arcuate element 41 via the chain elements 46 that are also attached to the opposite end of the arcuate element 41 via a set of tension latches 48 that engage the springs 42 to complete the assembly as illustrated in FIG. 4.

Figure 10:
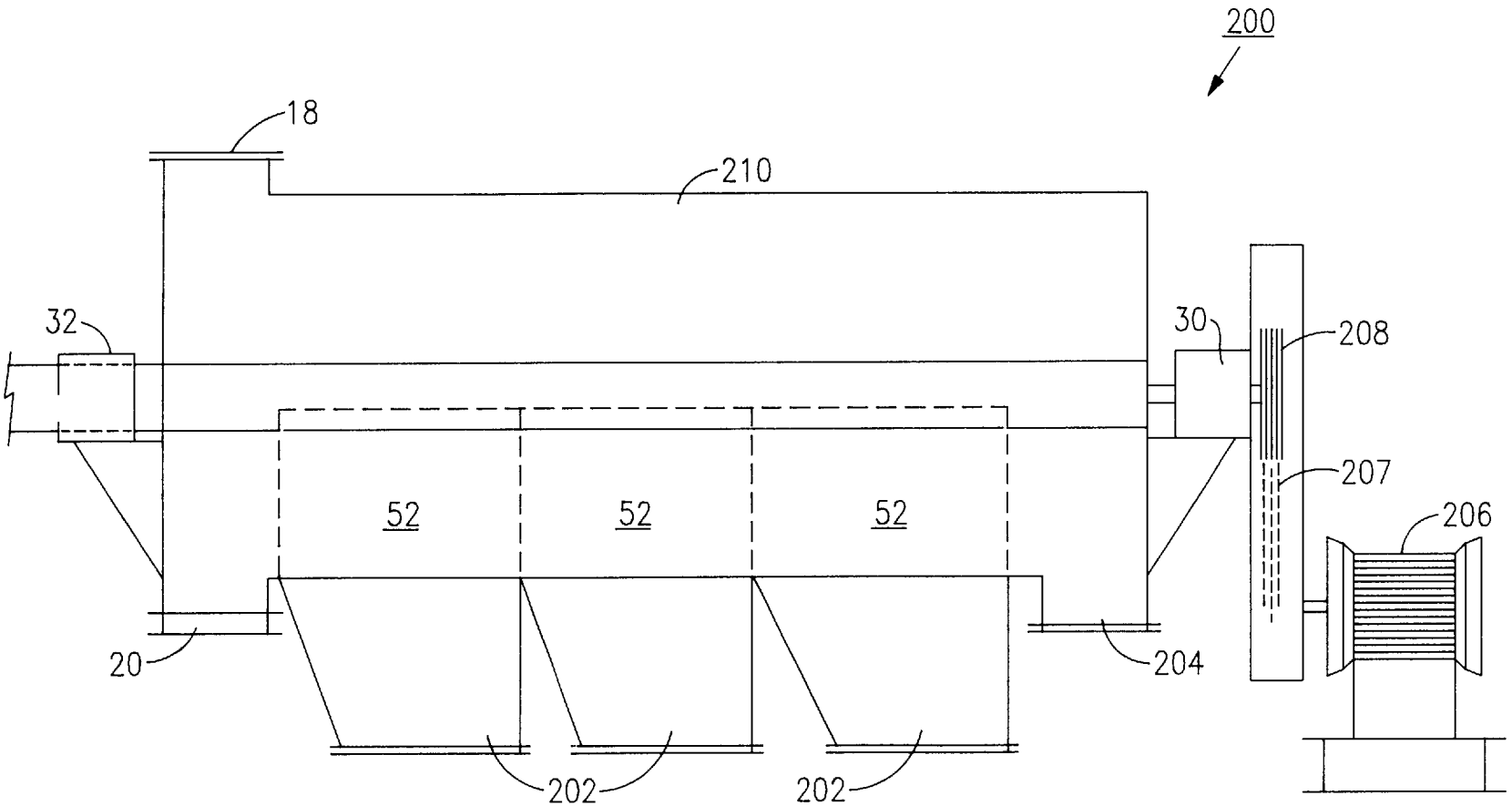
FIG. 10 illustrates a grinding apparatus suitable for attaching multiple screening elements in conformance with another embodiment of the present invention.

With continued reference to FIGS. 1–4, and with reference also to FIG. 10, there is disclosed in accordance with one preferred embodiment of the present invention, a grinding apparatus 10 comprising a substantially cylindrical product grinding chamber having a rotatable hammer assembly 22, 24 axially disposed there through, the rotatable hammer assembly 22, 24 having a plurality of circumferentially spaced hammers 24 defining a rotation path therein; at least one inlet port 18 through which at least one product can be introduced into the substantially cylindrical grinding chamber; at least one discharge port 202 through which any comminuted product can be discharged from the substantially cylindrical grinding chamber; a plurality of breaker bars 26 attached to selected portions of the periphery of the substantially cylindrical grinding chamber, each breaker bar 26 within the plurality of breaker bars 26 being substantially perpendicular to a tangent of the rotation path of the hammers 24 defined at each breaker bar 26; wherein the substantially cylindrical grinding chamber comprises a plurality or arcuate back bars 50, each arcuate back bar 50 within the plurality of arcuate back bars 50 being substantially parallel to a tangent of the rotation path of the hammers 24 defined at each back bar 50; and at least one arcuate screening element 52 attached to the plurality of back bars 50 such that a first inside radius prescribed the at least one arcuate screening element 52 and a second radius prescribed by the plurality of breaker bars 26 are equidistant from a common central axis defined by the rotatable hammer assembly 22, 24 and the substantially cylindrical grinding chamber.

Figure 5:
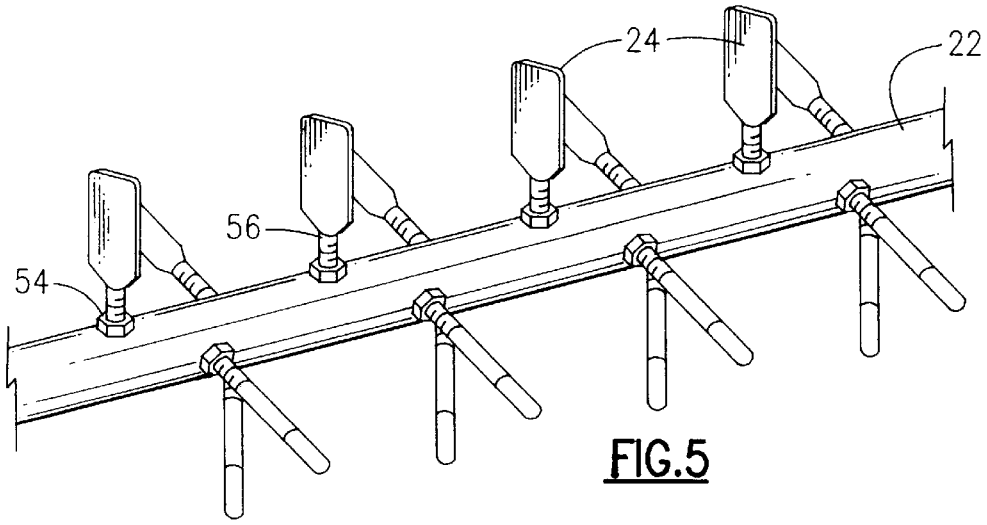
FIG. 5 illustrates a plurality of beaters/hammers coupled to a rotating shaft in conformance with one preferred embodiment of the present invention.

Moving now to FIG. 5, a plurality of beaters/hammers 24 are shown coupled to a rotating shaft 22 in conformance with one preferred embodiment of the present invention. The pitch of the beaters/hammers 24 are individually and selectively adjustable to control the slashing angle and cutting action of the beaters/hammers 24 and to control the rate of product flow through the grinding chamber cylinder housing 36 as discussed herein above. The present inventors have found that proper pitch selection greatly aids in providing a fan action toward the discharge end of the grinding apparatus 10 such that it becomes unnecessary to provide a negative air flow to accommodate dust removal from within the apparatus 10, therefore providing continuous cleaning action that reduces the necessity to implement a rigorous maintenance schedule commonly used with hammer mills, for example. The length of the beaters/hammers 24 are also individually and selectively adjustable via a tension nut 54 or other suitable fastening hardware, and a threaded neck 56 that forms a portion of each beater/hammer 24 to selectively and rigidly secure the desired pitch and hammer 24 length. The adjustable length feature allows the operator to maintain a close tolerance between the ends of the beaters/hammers 24 and the working surfaces of the breaker bars 26 as well as between the ends of the beaters/hammers 24 and the working surfaces of the screening element(s) 52, thereby optimizing the efficiency of the grinding apparatus 10.

Figure 6:
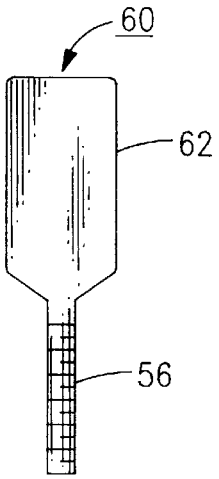
FIG. 6 illustrates a beater/hammer structure suitable for use with the present invention.

FIG. 6 illustrates a beater/hammer structure 60 suitable for use with the present invention. Those skilled in the art will appreciate that use of beaters/hammers 24 having wide paddles 62 are useful in some processing applications to ensure the entire surface area of the screening element(s) 52 is traversed during the grinding process. Preferably, the aforesaid paddles 62 are selectively constructed of a hardened base material such as tungsten carbide, although any sufficiently hardened base metal, e.g. carbon steel, will provide the desired grinding action.

Figure 7:
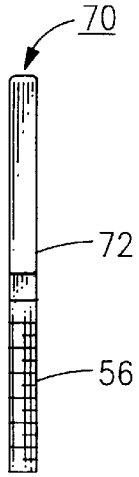
FIG. 7 illustrates another beater/hammer configuration suitable for use with the present invention.

FIG. 7 illustrates another beater/hammer configuration 70 suitable for use with the present invention. The beater/hammer 70 includes a narrow paddle 72. The present inventors found the narrow configuration provided a more efficient grinding process for some applications.

Figure 8:
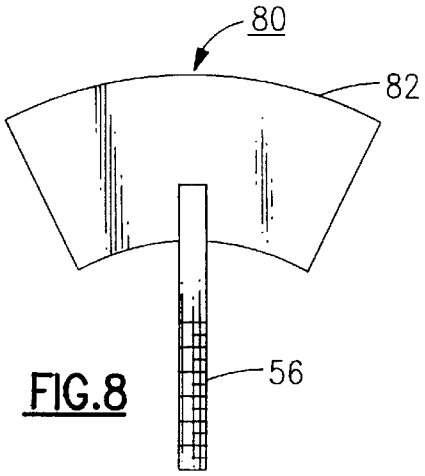
FIG. 8 illustrates yet another beater/hammer configuration suitable for use with the present invention.

FIG. 8 illustrates yet another beater/hammer configuration 80 suitable for use with the present invention. The beater/hammer 80 includes a very wide paddle 82. The very wide paddle 82 was found by the present inventors to prohibit wrapping action of certain packaged materials such as bakery waste where plastics are ground and separated from the packaged materials simultaneously. As stated herein before, the wider paddle configurations also traverse the entire surface of the screening element(s) 52, thereby forcing more material through the screening element(s) 52 resulting in a more efficient grinding process.

Figure 9:
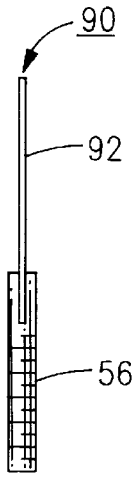
FIG. 9 illustrates still another beater/hammer configuration suitable for use with the present invention.

FIG. 9 illustrates still another beater/hammer configuration 90 suitable for use with the present invention. The beater/hammer 90 includes a very narrow paddle 92. It will readily be apparent to those skilled in the art that the foregoing very narrow paddle 92 will provide a more efficient grinding process for certain types of products, although a greater number of beaters/hammers 24 may be required in limited situations. The present inventors found that configurations including different combinations of paddle 92 structures provided improved comminuting when certain types of products or combinations of products were being processed through the grinding machine 10. Factors that influence the type of beater/hammer(s) 24 selected include, but are not limited to fiber size, type and strength; product type, e.g. dry (solid, powder) or liquid, combinations of dry and liquid; adhesive characteristics; purity; and the like. For example, products that can be efficiently processed with the grinding apparatus 10 may include virtually any powder and/or liquid such as snack foods, dry and wet soup mixes, bakery goods, gelatins, cereals, soft drinks, juices, milk, dry drink mixes, detergents, canned and frozen vegetables, barley, gypsum board, cement, corrugated cartons, plastic bottles and metal cans. When used for product separation applications, the end discharge port (enumerated as 204 in FIG. 10) opposite the inlet end of the grinding apparatus is also necessary, as stated herein before.

Moving now to FIG. 10, a side view of a grinding apparatus 200 suitable for attaching multiple screening elements 52 in conformance with another preferred embodiment of the present invention is illustrated. It shall be understood that each individual screening element 52 can have a mesh that is unique and distinct from any mesh associated with a different screening element to accommodate comminuting the product(s) into different particle sizes. The processed product(s) can then be collected in different collection chambers 202 to separate the final processed product(s) such that different particle sizes can be obtained from the grinding apparatus 200. Preferably, the grinding apparatus 200 has an escape port 204 to allow removal of any piece of foreign material that may inadvertently enter the apparatus 200 before the foreign material can cause damage to any one or more of the screening elements 52. For example, a piece of heavy metal would gravitate into the escape port 204 after it has been introduced through the feeder inlet 18 while the lighter product to be pulverized would be pulled into the grinding chamber (enumerated as 300 in FIG. 11) due to the aforesaid fan action of the beater/hammers 24. This feature is a radical departure from those grinding apparatus presently used in the art which attempt to also force such foreign material through the screening element thereby causing severe damage to the screening element. As described herein before, the grinding apparatus 200 preferably includes a v-belt drive unit 208 coupled to a variable speed motor 206 such that the rotational speed of the beaters/hammers 24 can be varied to accommodate a wide variety of products and product mixes. However, as stated herein before, the present invention is not so limited; and it shall be understood that the grinding apparatus will also function according to the present invention even when using a fixed speed drive motor or when using a directly coupled drive motor. Most preferably, the grinding apparatus 200 has a cylinder 210 long enough to accommodate a grinding chamber length of up to 96-inches or longer. The lengthened grinding chamber provides for an increased breaker bar 26 and screening element 52 grinding area substantially greater than conventional hammer mills known in the art.

It shall be understood that the present inventive grinding apparatus 200 can also be configured to function using a reverse rotation of the main drive shaft 28 simply by using a reversible drive motor in combination with rotating the hammer 24 assemblies. In this manner, a more even distribution of wear can be obtained for the sides of the hammers 24 and the breaker bars 26.

With continued reference to FIG. 10 and also with reference to FIGS. 1–9 and 11, a preferred embodiment is illustrated for a grinding apparatus 200 comprising: a substantially cylindrical grinding chamber defined by a solid arcuate wall portion 41 and a perforated arcuate wall portion 43; a plurality of rib members 50; at least one arcuate screen element 52 coupled to the plurality of rib members 50 to form the perforated arcuate wall portion 43 such that the perforated wall portion 43 has an inner radius prescribed by the at least one arcuate screen element 52; wherein the solid arcuate wall portion 41 is adapted to mate with the perforated arcuate wall portion 43 to form a substantially cylindrical housing 36 defining the substantially cylindrical grinding chamber therein; a rotatable hammer assembly 22, 24, 54, 56 axially disposed through the grinding chamber, the rotatable hammer assembly 22, 24, 54, 56 having a plurality of circumferentially spaced hammers 24 defining a rotation path therein; a means 18 for introducing at least one product into the substantially cylindrical grinding chamber; a means 202 for discharging comminuted product from the substantially cylindrical grinding chamber; and a plurality of breaker bars 26 attached to selected portions of an inner surface prescribed the solid arcuate wall portion 41 such that an inside radius defined by the plurality of breaker bars 26 and the inside radius defined by the perforated arcuate wall portion 43 are equidistant from a common central axis prescribed by the rotatable hammer assembly and the substantially cylindrical grinding chamber.

Figure 11:
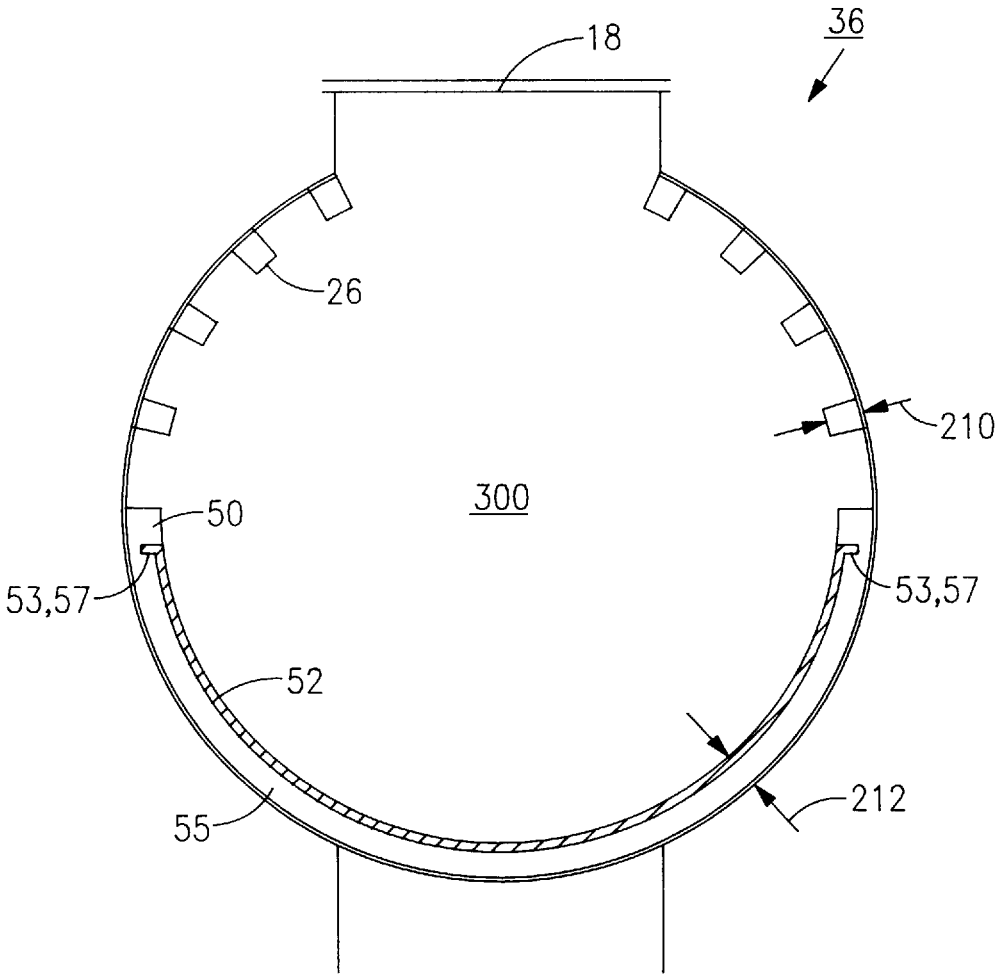
FIG. 11 is a detailed end view of a screening section for the grinding apparatus shown in FIGS. 1 and 10, illustrating structural placement of breaker bars and a screening element in conformance with one preferred embodiment of the present invention.

FIG. 11 is a detailed end view of a screening section for the grinding apparatus 10, 200 shown in FIGS. 1 and 10, illustrating structural placement of breaker bars 26 and a screening element 52 in conformance with one preferred embodiment of the present invention. The grinding chamber cylinder housing 36 is preferably constructed as described herein before and includes the arcuate element 41, compression springs 42, eye bolts 44 and chains 46 illustrated in FIG. 4. Therefore, those elements will not be discussed again herein below to preserve clarity and brevity. With continued reference to FIG. 11, it can be seen that the novel grinding chamber 300 represents a radical departure in the art of grinding, comminuting, waste disposal and recycling apparatus such as conventional hammer mills known to those skilled in the art. The novel grinding chamber 300 preferably has a plurality of identically sized breaker bars 26 attached to selected portions of the inner surface of the grinding chamber cylinder housing 36. A set of back bars 50 is also attached to selected portions of the inner surface of the grinding chamber cylinder housing 36 as shown. The back bars 50 have a recessed portion including a keyway 57 adapted to removably receive a predetermined size screening element 52. It is important to note that the inner surfaces of the breaker bars 26 and the inner surface of each screening element 52 are equidistant from the axis of the rotating shaft 22. The equidistant feature is achieved by ensuring the thickness 210 of the breaker bars 26 is identical with the combined thickness 212 of the back bars 50 and the attached screening elements 52. It is intuitively obvious that a thick screening element 52 will require a deeper recess 55 than a thin screening element 52 that will require a more shallow recess 55 within the associated back bar 50. Conventional grinding apparatus that use breaker bars and screening elements solely utilize the breaker bars to pulverize the constituents. Because the screening elements in those conventional grinding apparatus are much thinner (less height) than the thickness of the breaker bars, the screening elements contribute little or no pulverizing action as the beaters/hammers rotate past the screening elements, thereby losing some of the desired grinding/pulverizing efficiency. The apparatus 10, 200 disclosed herein address this deficiency by also using the screening elements 52 to enhance and optimize the desired grinding/pulverizing process as described herein above. It shall be understood that the present invention is not so limited however, and that the grinding chamber cylinder housing 36, although described in the immediate embodiment as a cylinder having a single unitary wall, can just as well be constructed with a solid arcuate wall portion 41 coupled to a perforated arcuate wall portion 43 as described herein before with reference to FIGS. 3 and 4.

Having thus described the preferred embodiments in sufficient detail as to permit those of skill in the art to practice the present invention without undue experimentation, those of skill in the art will readily appreciate other useful embodiments within the scope of the claims hereto attached. For example, although the present invention has been described as useful for the waste disposal and recycling industries, those of skill in the art will readily understand and appreciate that the present invention has substantial use and provides many benefits in other industries as well. Some of these may include practicing the present invention to provide mixing and blending of certain constituents. In general, the waste disposal community would find the present invention useful in separating unusable dry or liquid products from their packaging such as out-of-spec, dated and mislabeled products including virtually an powder or liquid, whether it is packaged in corrugated cartons, plastic bottles or metal cans, as well as a wide variety of applications where purity standards must be maintained. For example, it shall be understood that a water manifold can be installed with the present grinding apparatus to provide clean-in-place capabilities thereby allowing an easy switch from one product to another without cross-contamination.

In view of the foregoing descriptions, it should be apparent that the present invention represents a significant departure from the prior art in construction and operation. However, while particular embodiments of the present invention have been described herein in detail, it is to be understood that various alterations, modifications and substitutions can be made therein without departing in any way from the spirit and scope of the present invention, as defined in the claims which follow.

We claim:

1. A grinding apparatus comprising:

a substantially cylindrical product grinding chamber having a rotatable hammer assembly axially disposed there through, said rotatable hammer assembly having a plurality of circumferentially spaced hammers defining a rotation path therein;

at least one inlet port through which at least one product can be introduced into said substantially cylindrical grinding chamber;

at least one discharge port through which any comminuted product can be discharged from said substantially cylindrical grinding chamber;

a plurality of breaker bars attached to selected portions of the periphery of said substantially cylindrical grinding chamber, each breaker bar within said plurality of breaker bars being substantially perpendicular to a tangent of said rotation path of said hammers defined at each said breaker bar;

wherein said substantially cylindrical grinding chamber comprises a plurality of arcuate back bars, each arcuate back bar within said plurality of arcuate back bars being substantially parallel to a tangent of said rotation path of said hammers defined at each back bar; and at least one arcuate screening element attached to said plurality of back bars such that a first inside radius prescribed by said at least one arcuate screening element and a second inside radius prescribed by said plurality of breaker bars are equidistant from a common central axis defined by said rotatable hammer assembly and said substantially cylindrical grinding chamber.

2. The grinding apparatus of claim 1 wherein said substantially cylindrical grinding chamber further comprises a solid arcuate wall portion, said solid arcuate wall portion adapted to form a substantially cylindrical housing when said plurality of arcuate back bars and said at least one screening element are coupled to said solid arcuate wall portion.

3. The grinding apparatus of claim 2 further comprising at least one foreign debris trap adapted to capture unwanted debris inadvertently entering said inlet port and further preventing said unwanted debris from entering said substantially cylindrical grinding chamber.

4. The grinding apparatus of claim 3 further comprising at least one escape chamber adapted to capture and remove unwanted foreign debris flowing through said substantially cylindrical grinding chamber.

5. The grinding apparatus of claim 4 wherein each hammer within said plurality of circumferentially spaced hammers comprises a threaded neck portion.

6. The grinding apparatus of claim 5 wherein each said hammer further comprises a beater blade.

7. The grinding apparatus of claim 6 wherein said rotatable hammer assembly comprises a solid cylindrical shaft adapted to removably receive said threaded neck portion of each said hammer such that each said beater blade can be rotated to achieve a desired pitch and further such that each said hammer can be rotated a desired distance into said solid cylindrical shaft.

8. The grinding apparatus of claim 7 wherein said rotatable hammer assembly further comprises a plurality of threaded fastening hardware adapted to selectively and rigidly secure said desired pitch and said desired distance.

9. The grinding apparatus of claim 8 further comprising at least one access door adapted to allow operator access to said substantially cylindrical grinding chamber, said rotatable hammer assembly, said plurality of back bars, said at least one screening element and said plurality of breaker bars.

10. The grinding apparatus of claim 9 further comprising a reversible drive assembly wherein said solid cylindrical shaft is coupled to said reversible drive assembly and wherein said reversible drive assembly is configured to selectively rotate said solid cylindrical shaft in at least one prescribed direction.

11. The grinding apparatus of claim 10 wherein said reversible drive assembly comprises a variable speed drive motor wherein said solid cylindrical shaft is coupled to said variable speed drive motor to variably control rotational speed of said rotatable hammer assembly.

12. The grinding apparatus of claim 10 wherein said reversible drive assembly comprises a fixed speed drive motor.

13. A grinding apparatus comprising:

a substantially cylindrical housing defining a product grinding chamber therein;

a rotatable hammer assembly axially disposed through said product grinding chamber, said rotatable hammer assembly having a plurality of circumferentially spaced hammers defining a rotation path therein;

at least one feeder port through which at least one product can be introduced into said product grinding chamber;

at least one discharge port through which any comminuted product can be discharged from said product grinding chamber;

a plurality of breaker bars attached to first selected inner surface portions of said substantially cylindrical housing, each breaker bar within said plurality of breaker bars being substantially perpendicular to a tangent of said rotation path of said hammers defined at each said breaker bar;

a plurality of back bars attached to second selected inner surface portions of said substantially cylindrical housing; and at least one arcuate screening element attached to said plurality of back bars such that a first inside radius defined by said at least one arcuate screening element and a second inside radius defined by said plurality of breaker bars are equidistant from a common central axis defined by said substantially cylindrical housing and said rotatable hammer assembly.

14. The grinding apparatus of claim 13 wherein each hammer within said plurality of circumferentially spaced hammers comprises a threaded neck.

15. The grinding apparatus of claim 14 wherein each said hammer further comprises at least one beater blade.

16. The grinding apparatus of claim 15 wherein said rotatable hammer assembly comprises a solid cylindrical shaft adapted to removably receive said threaded neck of each said hammer such that each at least one beater blade can be rotated a desired distance into said solid cylindrical shaft.

17. The grinding apparatus of claim 16 wherein said rotatable hammer assembly further comprises a plurality of threaded fastening hardware adapted to selectively and rigidly secure said desired pitch and said desired distance.

18. The grinding apparatus of claim 17 further comprising at least one foreign debris trap adapted to capture unwanted debris inadvertently entering said inlet port and further preventing said unwanted debris from entering said substantially cylindrical grinding chamber.

19. The grinding apparatus of claim 18 further comprising at least one escape chamber adapted to capture and remove unwanted foreign debris flowing through said substantially cylindrical grinding chamber.

20. The grinding apparatus of claim 19 further comprising at least one access door adapted to allow operator access to said product grinding chamber, said rotatable hammer assembly, said plurality of back bars, said at least one screening element and said plurality of breaker bars.

21. The grinding apparatus of claim 20 further comprising a reversible drive assembly wherein said solid cylindrical shaft is coupled to said reversible drive assembly and wherein said reversible drive assembly is configured to selectively rotate said solid cylindrical shaft in at least one prescribed direction.

22. The grinding apparatus of claim 21 wherein said reversible drive assembly comprises a variable speed motor and wherein said variable speed motor is configured to variably control rotational speed of said rotatable hammer assembly.

23. The grinding apparatus of claim 21 wherein said reversible drive assembly comprises a fixed speed motor.

24. A grinding apparatus comprising:

a substantially cylindrical grinding chamber defined by a solid arcuate wall portion and a perforated arcuate wall portion;

a plurality of rib members;

at least one arcuate screen element coupled to said plurality of rib members to form said perforated arcuate wall portion such that said perforated arcuate wall portion has an inner radius prescribed by said at least one arcuate screen element;

wherein said solid arcuate wall portion is adapted to mate with said perforated arcuate wall portion to form a substantially cylindrical housing defining said substantially cylindrical grinding chamber therein;

a rotatable hammer assembly axially disposed through said grinding chamber, said rotatable hammer assembly having a plurality of circumferentially spaced hammers defining a rotation path therein;

a means for introducing at least one product into said substantially cylindrical grinding chamber;

a means for discharging comminuted product from said substantially cylindrical grinding chamber; and a plurality of breaker bars attached to selected portions of an inner surface prescribed by said solid arcuate wall portion such that an inside radius defined by said plurality of breaker bars and said inside radius defined by said perforated arcuate wall portion are equidistant from a common central axis prescribed by said rotatable hammer assembly and said substantially cylindrical grinding chamber.

25. The grinding apparatus of claim 24 wherein each hammer within said plurality of circumferentially spaced hammers comprises a threaded neck portion.

26. The grinding apparatus of claim 25 wherein said rotatable hammer assembly comprises a solid shaft adapted to removably receive said threaded neck portion of each said hammer such that each said hammer can be rotated to achieve a desired pitch and further such that each said hammer can be rotated a desired distance into said solid shaft.

27. The grinding apparatus of claim 26 wherein said rotatable hammer assembly further comprises a plurality of fastening devices adapted to selectively and rigidly secure said desired pitch and said desired distance.

28. The grinding apparatus of claim 27 further comprising at least one access door adapted to allow operator access to said substantially cylindrical grinding chamber, said rotatable hammer assembly, said plurality of ribs, said at least one screen element and said plurality of breaker bars.

29. The grinding apparatus of claim 28 further comprising at least one foreign debris trap adapted to capture unwanted debris inadvertently entering said inlet port and further preventing said unwanted debris from entering said substantially cylindrical grinding chamber.

30. The grinding apparatus of claim 29 further comprising at least one escape chamber adapted to capture and contain unwanted debris flowing through said substantially cylindrical grinding chamber.

31. The grinding apparatus of claim 30 further comprising a reversible drive assembly wherein said solid shaft is coupled to said reversible drive assembly and wherein said reversible drive assembly is configured to selectively rotate said solid cylindrical shaft in at least one prescribed direction.

32. The grinding apparatus of claim 31 wherein said reversible drive assembly comprises a variable speed drive motor and wherein said variable speed drive motor is configured to variably control rotational speed of said rotatable hammer assembly.

33. The grinding apparatus of claim 31 wherein said reversible drive assembly comprises a fixed speed drive motor.

* * * * *